United States Patent [19]

Sato et al.

[11] Patent Number: 4,827,266

[45] Date of Patent: May 2, 1989

[54] ANTENNA WITH LUMPED REACTIVE MATCHING ELEMENTS BETWEEN RADIATOR AND GROUNDPLATE

[75] Inventors: Shinichi Sato; Fumio Takeda, Both of Kamakura, Japan

[73] Assignee: Mitsubishi Denki Kabushiki Kaisha, Tokyo, Japan

[21] Appl. No.: 830,846

[22] Filed: Feb. 19, 1986

[30] Foreign Application Priority Data

Feb. 26, 1985 [JP] Japan ..... 36952

[51] Int. Cl.[4] ..... H01Q 1/38

[52] U.S. Cl. ..... 343/700 MS; 343/749; 343/830

[58] Field of Search ..... 343/700 MS, 745, 749, 343/829, 830, 846

[56] References Cited

U.S. PATENT DOCUMENTS

| | | | |
|---|---|---|---|
| 3,680,136 | 7/1972 | Collings | 343/700 MS |
| 3,838,429 | 9/1974 | Reggia | 343/830 |
| 3,852,760 | 12/1974 | Reggia | 343/830 |
| 4,074,270 | 2/1978 | Kaloi | 343/700 MS |
| 4,259,670 | 3/1981 | Schiavone | 343/700 MS |
| 4,475,108 | 10/1984 | Moser | 343/700 MS |

FOREIGN PATENT DOCUMENTS

| | | | |
|---|---|---|---|
| 182203 | 9/1985 | Japan | 343/700 MS |

OTHER PUBLICATIONS

"Microstrip Antennas with Frequency Agility and Polarization Diversity", by D. H. Schaubert et al., IEEE Transactions On Antennas and Propagation, vol. Ap-.-29, No. 1, Jan. 1981, pp. 118 to 123.

*Primary Examiner*—William L. Sikes
*Assistant Examiner*—Michael C. Wimer
*Attorney, Agent, or Firm*—Lowe, Price, Leblanc, Becker & Shur

[57] ABSTRACT

Between a circular conductor plate and a grounding conductor plate, lumped constant elements such as coils and capacitors are connected. As a result, the resonance frequency of an antenna can be changed in a wide range.

11 Claims, 3 Drawing Sheets

ANTENNA WITH LUMPED REACTIVE MATCHING ELEMENTS BETWEEN RADIATOR AND GROUNDPLATE

BACKGROUND OF THE INVENTION

The present invention relates to an antenna and particularly to an antenna of a small size having an excellent impedance characteristic.

DESCRIPTION OF THE PRIOR ART

FIGS. 1 and 2 are a perspective view and a side view, respectively, of a conventional antenna. Referring to the figures, a circular conductor plate 1 is disposed parallel and opposed to a grounding conductor plate 2 with a predetermined distance from the grounding conductor plate 2. In the grounding conductor plate 2, a coaxial connector 3 is provided on the surface not facing the circular conductor plate 1. The inner conductor 4 of the coaxial connector 3 extends through the grounding conductor plate 2 so as to be connected to the circular conductor plate 1. Between the circular conductor plate 1 and the grounding conductor plate 2, short-circuiting posts 5*a* and 5*b* are provided. Such a conventional antenna is described for example in "Microstrip Antennas with Frequency Agility and Polarization Diversity" by D. H. Schaubert, F. G. Farrar, A. Sindoris and S. T. Hayes, IEEE TRANSACTIONS ON ANTENNAS AND PROPAGATION, Vol. Ap-29, No. 1, Jan. 1981 pp. 118 to 123.

In such an antenna formed as described above, electric power fed by the coaxial connector 3 excites radio waves between the circular conductor plate 1 and the grounding conductor plate 2 through the inner conductor 4. In such an antenna, the resonance frequency is determined by the radius of the circular conductor plate 1. However, by means of the short-circuiting posts 5*a* and 5*b* provided between the circular conductor plate 1 and the grounding conductor plate 2, the impedance viewed from the feeding point of the coaxial connector 3 is changed and accordingly, the resonance frequency of the antenna can be lowered. As a result, a lower frequency can be transmitted or received without increasing the radius of the circular conductor plate 1 and thus, the size of the antenna can be made small.

Although the resonance frequency of the conventional antenna can be changed by changing the thickness, the number of the positions of short-circuiting posts, a range of change of the resonance frequency is relatively narrow. Consequently, such a conventional antenna has disadvantages that even if short-circuiting posts are used, it is difficult to make the antenna match with a wide bandwidth and the size of the antenna cannot be made so small.

SUMMARY OF THE INVENTION

An object of the present invention is to provide an antenna in which matching with a wide bandwidth can be made more freely.

Briefly stated, the present invention is an antenna where lumped constant elements such as coils and capacitors are connected between a grounding conductor plate and a conductor plate.

According to the present invention, the lumped constant elements connected between a grounding conductor plate and a conductor plate in an antenna can be set to various values whereby the antenna can be matched with a wide bandwidth. Therefore, even if the radius of the conductor plate is considerably small compared with the wavelength of a signal to be transmitted or to be received, the transmitting and receiving characteristics of the antenna will never be deteriorated and consequently, the antenna can be made to have an extremely small size.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
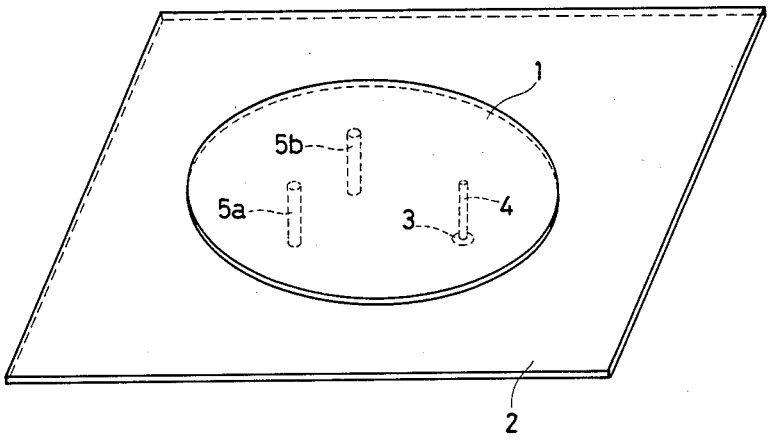
FIG. 1 PRIOR ART
FIGS. 1 and 2 are a perspective view and a side view, respectively, showing a structure of a conventional antenna.
Figure 2:
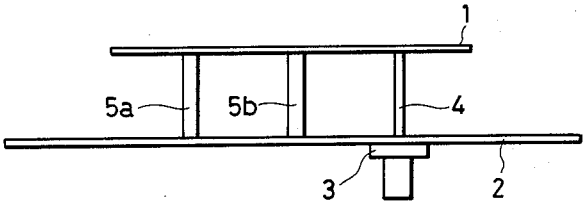
FIG. 2 PRIOR ART
Figure 3:
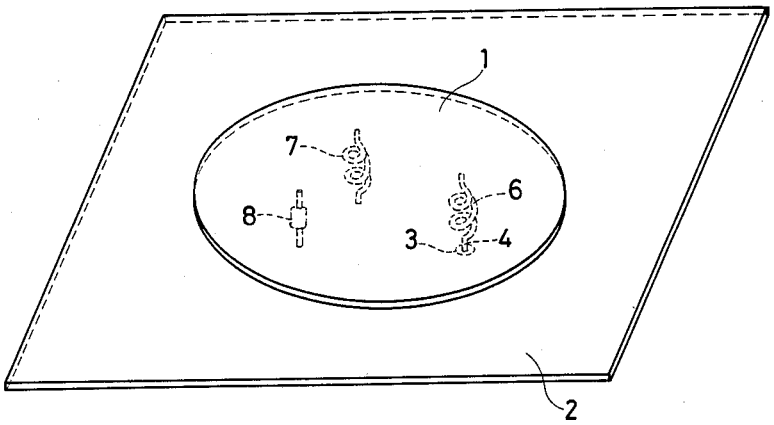
FIGS. 3 and 4 are a perspective view and a side view, respectively, showing a structure of an antenna of an embodiment of the present invention.
Figure 4:
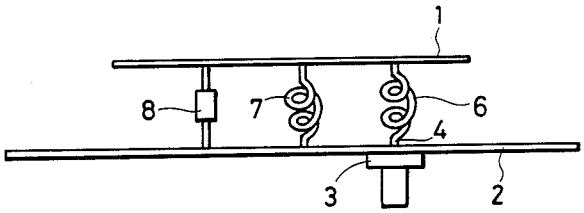

FIGS. 3 and 4 are a perspective and a side views, respectively, showing a structure of an antenna of an embodiment of the present invention. In this embodiment, the same portions as in the conventional example shown in FIGS. 1 and 2 are indicated by the same reference numerals and a detailed description thereof will be omitted. Referring to FIGS. 3 and 4, a coil 7 and a capacitor 8 are provided in this embodiment instead of the short-circuiting posts 5*a* and 5*b* (as shown in FIGS. 1 and 2). One end of the coil 7 and that of the capacitor 8 are connected to a circular conductor plate 1 and the other ends thereof are connected to a grounding conductor plate 2. In an intermediate portion of an inner conductor 4 located between the circular conductor plate 1 and the grounding conductor plate 2, a feeding coil 6 is provided in series.

In such arrangement as described above, the thickness and the turns of the feeding coil 6 and the coil 7 as well as the capacity of the capacitor 8 are changed suitably or the number and the positions of coils 7 and capacitors 8 are changed suitably so that the impedance can be changed in a by far wider range than in the case of using the short-circuiting posts shown in FIGS. 1 and 2. Thus, an antenna having a wider bandwidth than in a conventional antenna can be obtained and the size of the antenna can be made extremely small.

Figure 5:
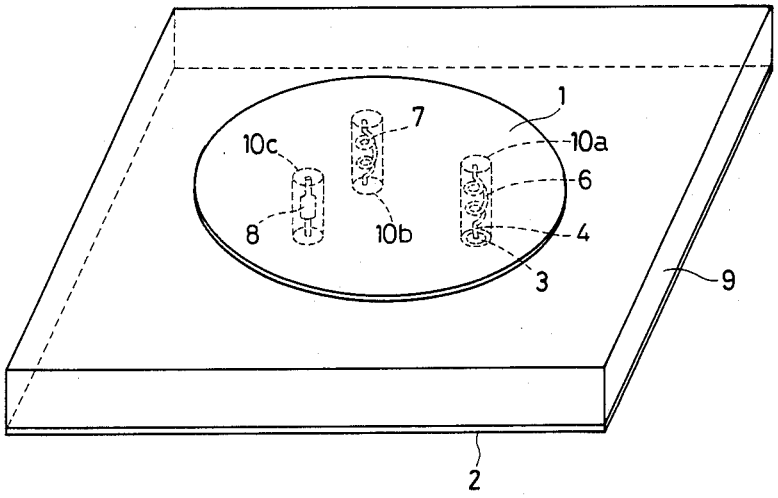
FIGS. 5 and 6 are a perspective view and a side view, respectively, showing a structure of an antenna of another embodiment of the present invention.
Figure 6:
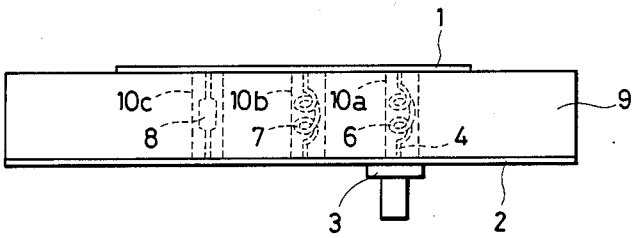

FIGS. 5 and 6 are a perspective and a side views, respectively, showing a structure of an antenna of another embodiment of the present invention. This embodiment is the same as the embodiment shown in FIGS. 3 and 4 except for the below described point and therefore, a description of the same points as in the above described embodiment will be omitted suitably by using the same reference numerals for them. In the embodiment shown in FIGS. 5 and 6, a dielectric substrate 9 is provided between the circular conductor plate 1 and the grounding conductor plate 2. In the dielectric substrate 9, holes 10*a* 10*b* and 10*c* are formed. These holes 10*a* 10*b* and 10*c* are the holes which coils 6 and 7 and a capacitor 8 pass through respectively.

In the case of this embodiment, as in the previously described embodiment shown in FIGS. 3 and 4, an antenna having a desired wide bandwidth characteristic can be obtained by changing suitably the thickness and the turns of the feeding coil 6 and the coil 7 as well as the capacity of the capacitor 8 or by changing the number and the positions of coils 7 and capacitor 8.

Figure 7:
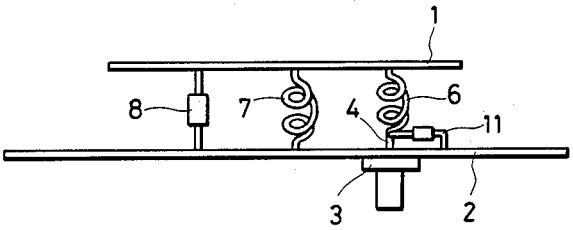
FIG. 7 is a side view showing a structure of an antenna of a further embodiment of the present invention.

FIG. 7 is a side view showing a structure of an antenna of a further embodiment of the present invention. This embodiment is the same as in the embodiment shown in FIGS. 3 and 4 except for the below described point and therefore, a description of the same portions as in the embodiment shown in FIGS. 3 and 4 will be omitted suitably by using the same reference numerals for them. In this embodiment shown in FIG. 7, a feeding coil 6 is provided in series and a feeding capacitor 11 is provided in parallel in intermediate portions of the inner conductor 4 between the circular conductor plate 1 and the grounding conductor plate 2. More specifically, the feeding capacitor 11 has one end connected to the inner conductor 4 and the other end connected to the grounding conductor plate 2. This feeding capacitor 11 as well as other lumped constant elements (the feeding coil 6, the coil 7, the capacitor 8 etc.) serves effectively as a matching element.

In the embodiment shown in FIG. 7, lumped constant elements are connected in series and in parallel between the circular conductor plate 1 and the grounding conductor plate 2 and consequently, as compared with an antenna where lumped constant elements are connected only in series, the value of impedance viewed from the feeding point can be set more finely. Accordingly, the resonance frequency of an antenna can be set to a desired value with high precision.

Although in the above described respective embodiments, lumped constant elements such as the coil 7, the capacitor 8 etc. are connected to the inner surface of the circular conductor plate 1, lumped constant elements may be connected between the outer peripheral portion of the circular conductor plate 1 and the grounding conductor plate 2.

In addition, taps may be provided in the portions of connection between the circular conductor plate 1 and the respective lumped constant elements so that the lumped constant elements can be connected and fixed easily.

In addition, although the circular conductor plate 1 was described in the above described respective embodiments, the conductor plate 1 is not limited to the circular form and as far as it has a plane form, it may be in any shape such as polygon.

Furthermore, although lumped constant elements are provided in series or in parallel in intermediate portions of the inner conductor 4 of the coaxial connector 3 in the above described embodiments, these lumped elements in the inner conductor 4 may be omitted and only by the other lumped constant elements provided between the circular conductor plate 1 and the grounding conductor plate 2, the matching characteristic can be sufficiently improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna comprising:

a first grounding conductor plate, a second conductor plate disposed parallel and opposed to said grounding conductor plate, a coaxial connector having inner and outer conductors arranged in a coaxial relation and provided on a surface of said first grounding conductor plate, not facing said first conductor plate, the inner conductor of said coaxial connector extending through said first grounding conductor plate and being connected to said second conductor plate at a first location spaced apart from a geometric center of said conductor plate, and a discrete capacitor and a coil disposed between said second conductor panel and said first grounding conductor plate, each having one end connected to said first grounding conductor plate and the other end connected to said second conductor plate at second and third spaced apart locations spaced apart from said first location and said second conductor plate, a reactive element connected between an intermediate portion of said inner conductor of said coaxial connector and said first grounding conductor plate and positioned above the surface of said first grounding conductor plate in the region between said second conductor plate and said first grounding conductor plate.

2. An antenna in accordance with claim 1, further comprising a dielectric substrate between said first grounding plate and said second conductor plate, said substrate containing bores in which said inner conductor, discrete capacitor and coil are respectively located.

3. An antenna in accordance with claim 1, further comprising a reactive element connected in series with a intermediate portion of said inner conductor of said coaxial connector located between said first grounding conductor plate and said second conductor plate.

4. An antenna comprising:

a first grounding conductor plate, a second conductor plate disposed parallel and opposed to said first grounding plate, a coaxial connector having inner and outer conductors arranged in a coaxial relation and provided on a surface of said first grounding conductor plate, not facing said second conductor plate, the inner conductor of said coaxial connector extending through said first grounding conductor plate and being connected to said second conductor plate at a first location, a capacitor disposed between said first grounding plate and said second conductor plate, said capacitor having one end connected to said first grounding conductor plate and the other end connected to said second conductor plate at a second location;

a coil disposed between said first grounding plate and said second conductor plate, said coil having one end connected to said first grounding conductor plate and the other end connected to said second conductor plate at a third location, said first, second and third locations spaced apart from each other on said second conductor plate;

a first reactive element connected between an intermediate portion of said inner conductor of said coaxial connector and said first grounding conductor plate and positioned above the surface of said first grounding conductor plate in the region between said second conductor plate and said first grounding conductor plate;

a second reactive element connected in series with an intermediate portion of said inner conductor of said coaxial connector located between said first grounding conductor plate and said second conductor plate; and a dielectric substrate provided between said first grounding plate and said second conductor plate, said substrate containing bores in which said inner conductor, capacitor, and coil are respectively located.

5. An antenna in accordance with claim 4, wherein said capacitor is a fixed value capacitor.

6. An antenna comprising:

a grounding conductor plate, a circular conductor plate disposed parallel and opposed to said grounding conductor plate, a coaxial connector having inner and outer conductors arranged in a coaxial relation and provided on a surface of said grounding conductor plate, not facing said circular conductor plate, the inner conductor of said coaxial connector extending through said grounding conductor plate and being connected to said circular conductor plate at a first location, a capacitor and a coil disposed between said circular conductor plate and said grounding conductor plate, each having one end connected to said grounding conductor plate and the other end connected to said circular conductor plate at a location spaced apart from said first location on said conductor plate, a reactive element connected between an intermediate portion of said inner conductor of said coaxial connector and said grounding conductor plate and positioned above the surface of said grounding conductor plate in the region between said circular conductor plate and said grounding conductor plate.

7. An antenna in accordance with claim 6, further comprising a reactive element selected from the group consisting of fixed value capacitors and fixed value coils connected in series with an intermediate portion of said inner conductor of said coaxial connector located between said grounding conductor plate and said circular conductor plate.

8. An antenna in accordance with claim 6, wherein said first location is spaced apart from a geometric center of said circular conductor plate.

9. An antenna in accordance with claim 6, further comprising a dielectric substrate between said grounding conductor plate and said circular conductor plate, said substrate containing bores in which respective ones of said coil, capacitor and inner conductor are individually located.

10. An antenna comprising:

a grounding conductor plate, a circular conductor plate disposed parallel and opposed to said grounding conductor plate, a coaxial connector having inner and outer conductors arranged in a coaxial relation and provided on a surface of said grounding conductor plate, not facing said circular conductor plate, the inner conductor of said coaxial connector extending through said grounding conductor plate and being connected to said circular conductor plate at a first location, a capacitor and a coil disposed between said circular conductor plate and said grounding conductor plate, each having one end connected to said grounding conductor plate and the other end connected to said circular conductor plate at second and third spaced apart locations spaced apart from said first location on said circular conductor plate, and a reactive element connected between an intermediate portion of said inner conductor of said coaxial connector and said grounding conductor plate and positioned above the surface of said grounding conductor plate in the region facing said circular conductor plate and said grounding conductor plate.

11. An antenna in accordance with claim 10, wherein said first location is spaced apart from a geometric center of said circular conductor plate.

* * * * *

UNITED STATES PATENT AND TRADEMARK OFFICE

CERTIFICATE OF CORRECTION

PATENT NO. : 4,827,266

DATED : May 2, 1989

INVENTOR(S) : Shinichi SATO et al.

It is certified that error appears in the above-identified patent and that said Letters Patent is hereby corrected as shown below:

ON THE TITLE PAGE:

The title should read as follows:

ANTENNA WITH LUMPED REACTIVE MATCHING ELEMENTS BETWEEN RADIATOR AND GROUND PLATE

Under [30] Foreign Application Priority Data, the Japanese reference number should correctly read as follows:

Feb. 26, 1985 [JP] Japan ..... 60-36952

Signed and Sealed this

Thirteenth Day of February, 1990

*Attest:*

JEFFREY M. SAMUELS

*Attesting Officer*

*Acting Commissioner of Patents and Trademarks*